US005565054A

United States Patent [19]

Lappe et al.

[11] Patent Number: 5,565,054

[45] Date of Patent: Oct. 15, 1996

[54] FILM PRINTING METHOD AND FILM PRINTING DEVICE

[76] Inventors: Kurt Lappe, Erlenstrasse 23, D-41470 Neuss, Germany; Fred Oudt, Albert Biesmanslaan 18, Bus 3.3, BE - 1560 Hoeilaart, Belgium

[21] Appl. No.: 137,169

[22] PCT Filed: Mar. 31, 1992

[86] PCT No.: PCT/DE92/00275

§ 371 Date: Nov. 19, 1993

§ 102(e) Date: Nov. 19, 1993

[87] PCT Pub. No.: WO92/17338

PCT Pub. Date: Oct. 15, 1992

[30] Foreign Application Priority Data

Apr. 4, 1991 [DE] Germany ..... 41 10 801.9

[51] Int. Cl.[6] ..... B44C 1/17

[52] U.S. Cl. ..... 156/234; 156/238; 156/241; 156/277; 156/312

[58] Field of Search ..... 156/230, 234, 156/238, 241, 277, 312, 540, 541, 542, 555, 580

[56] References Cited

U.S. PATENT DOCUMENTS

| | | | |
|---|---|---|---|
| 3,132,581 | 5/1964 | Isbey et al. | 156/555 X |
| 3,785,895 | 1/1974 | Ettre et al. | 156/89 |
| 4,340,438 | 7/1982 | Davis | 156/234 |
| 4,465,538 | 8/1984 | Schmoock | 156/233 |
| 4,589,942 | 5/1986 | Korinek | 156/148 |
| 4,869,767 | 9/1989 | Robinson et al. | 156/233 |
| 4,906,316 | 3/1990 | Seidl | 156/234 |
| 5,019,203 | 5/1991 | Singer | 156/309.9 |

*Primary Examiner*—James Sells
*Attorney, Agent, or Firm*—Robert W. Becker & Associates

[57] ABSTRACT

In a film printing method for printing a print design on a substrate areas of a surface of a substrate to be provided with a print design is coated in a first step with an adhesive layer. The transfer film for the printing method includes a support film having a separating layer connected thereto and a transfer layer connected to the separating layer. At a first pressure the transfer film with the transfer layer facing the adhesive layer is printed onto the substrate so that the transfer layer adheres to the adhesive layer of the substrate. The support film together with the separating layer is removed from the transfer layer adhering to the substrate. In a final step, the transfer layer adhering to the adhesive layer on the substrate is subjected to a second pressure that is substantially greater than the first pressure.

12 Claims, 3 Drawing Sheets

FILM PRINTING METHOD AND FILM PRINTING DEVICE

BACKGROUND OF THE INVENTION

The invention relates to a film printing method in which the transfer film, comprised of a support film and a transfer layer adhering to the transport film via a separating layer, is applied under pressure to a substrate to be provided with a print design and after removal of the transfer film the transfer layer partially or completely adheres to the substrate.

It is common to all known film printing methods that a film is partially applied under pressure to a substrate, for example, paper, cardboard, or foil in the form of sheets or endless material, and permantly fixed thereto. The transfer films are commonly in the form of foils with gold or silver appearance; however, transfer films in different colors with high gloss or mat gloss surfaces are known.

The application of the transfer film to the substrate is commonly achieved with the relief film printing method. This printing method is similar in its basic principle to the high pressure method and is in so far similar to book printing. The decisive common feature is that the printing parts of the printing mold are higher than the surrounding non-printing parts. During the printing process the print mold is indirectly heated and maintained at a uniform temperature. The printing medium that is transferred during the printing process from the printing foil to the substrate is comprised of a transfer layer in the form of a thin, multi-layer dry film which is releasably connected to a commonly transparent support film via a separating layer. The tranfer layer is comprised of two layers having a silver-colored aluminum deposit layer as well as a usually colored layer of lacquer. This double transfer layer is provided with a resin layer which upon heating has adhesive properties.

During the printing process the transfer film is guided together with the substrate to be provided with a printed design through a pressing mechanism whereby due to the pressure applied with the heated pressure mold with the elevated elements of the pressure mold predetermined locations of the transfer layer of the transfer film are removed and transferred to the substrate. Due to the heat transferred by the pressure mold the separating layer between the support film and the transfer layer is evaporated so that the transfer layer is easily removed from the support film. On the other hand, the resin layer is activated by the heat transfer from a dry state into a tacky state so that the resin layer forms an adhesive layer between the substrate and the transfer layer. As a result, at the locations predetermined by the printing mold, the transfer layer, for example, in the form of a gold-shimmering layer, is permanently applied to the substrate.

It is a disadvantage of the known film printing methods that the manufacture and positioning of the printing molds, i.e., of the stereotype plate, requires a very long preparation and adjustment time. Since the preparation and adjustment time taken up approximately half of the entire production process, the known film printing methods are, in general, very time consuming and therefor incur high production costs.

It is an object of the invention to develop a film printing method which, under consideration of the required preparation and adjusting times, makes possible substantially shorter total production times. Furthermore, a suitable film transfer device for carrying out the method should be provided.

SUMMARY OF THE INVENTION

The film printing method for printing a print design on a substrate according to the present invention is characterized by the following steps:

coating areas of a surface of a substrate to be provided with a print design with an adhesive layer;

providing a transfer film comprised of a support film having a separating layer connected thereto and a transfer layer connected to the separating layer;

printing at a first pressure the transfer film with the transfer layer facing the adhesive layer onto the substrate so that the transfer layer adheres to the adhesive layer of the substrate;

removing the support film together with the separating layer from the transfer layer adhering to the substrate; and subjecting the transfer layer adhering to the adhesive layer on the substrate to a second pressure that is substantially greater than the first pressure.

The method preferably further comprising the step of employing a smooth printing surface for performing the step of printing, wherein the smooth printing surface is preferably elastic.

The method is expediently performed such that the first pressure is insufficient to press the transfer layer into the substrate.

The step of pressing according to the present invention is advantageously performed at ambient temperature.

For the printing step two counter-rotating rollers of a first calender are provided. Expediently, in the step of subjecting to a second pressure two further counter-rotating rollers of a second calender are employed.

Preferably, the first calender is operated at a fixed-cycle operation.

The step of coating includes the step of applying the adhesive in multiple steps. The adhesive is preferably a multi-component adhesive.

For applying the adhesive a single-color or multi-color printing device is used.

The present invention further relates to a transfer film printing device for transferring a print design from a transfer film to a substrate. According to the present invention the device comprises:

a printing station including:

a) a supply device for a transfer film, b) a removing device for the transfer film, and c) a printing mechanism having a printing surface and a first counter surface defining a printing slot for simultaneously guiding a substrate to be provided with a print design and the transfer film through the printing slot for transferring a print design from the transfer film to the substrate;

a device for applying an adhesive layer to the substrate, the device for applying an adhesive layer positioned upstream of the printing station and comprising an applicator; and a pressing device, positioned downstream of the printing station, having a pressing surface and a second counter surface defining a pressing slot for guiding the substrate with the transferred print design therethrough.

The pressing surface and the second counter surface are in the form of oppositely arranged calender rollers with a smooth surface. The printing surface and the first counter surface are preferably also in the form of oppositely arranged calender rollers with a smooth surface of a transfer calender.

Expediently, the printing surface is elastic.

The pressing device and the printing station preferably form a constructive unit.

The device for applying an adhesive layer is advantageously a conventional single-color or multi-color printing device.

As a solution to the above mentioned object it is inventively suggested that, in a method step preceeding the application of the transfer film, the surface of the substrate is provided with an adhesive layer for the transfer layer at the positions where the transfer layer application is desired and that, in a method step subsequent to the application of the transfer film, the substrate together with the transfer layer adhering thereto due to the adhesive layer is subjected to pressure that is substantially greater than the pressure applied during application of the transfer film.

With such a film transfer method the premanufacture of a printing mold, i.e., of a stereotype plate, is obsolete. In deviation from the known film printing methods, the transfer of the transfer layer no longer takes place by the partial pressure application within the area of the projecting portions of the printing mold, respectively, the stereotype plate. Before the method step of applying the transfer film, the substrate for film printing is provided with a partial adhesive layer which then receives within the pressing mechanism the transfer layer at the predetermined locations from the transfer film. Since the adhesive layer is applied to the substrate before the actual printing process, the resin layer which is commonly applied to the transfer film is obsolete. Furthermore, in deviation from the prior art, a heating of the printing surfaces is no longer required because, with the elimination of the resin layer on the transfer film, its heating for generating the tackiness is no longer needed.

In order to provide a permanent connection between the substrate and the transfer layer, in a subsequent method step following the application of the transfer film the substrate and the transfer layer adhered thereto are subjected to a pressure which substantially surpasses the pressure used during application of the transfer film.

Since the inventive method in contrast to the known methods no longer requires a printing mold, respectively, a stereotype plate, substantially reduced preparation and adjusting times are needed. Since furthermore the printing process can be performed at substantially increased speeds as compared to the known methods, substantially reduced manufacturing times and thus reduced production costs result. Since a heating of the printing surfaces during the transfer film application is no longer required, the inventive method furthermore operates at substantially reduced energy costs.

The inventive method allows the use of a smooth, optionally elastic pressing surface for applying pressure during the transfer film application. The magnitude of the pressure applied during the film transfer should be advantageously determined such that it is not sufficient to press the transfer film into the substrate. The pressure application however must be great enough to remove the transfer layer partially or areally from the support film.

In order to allow for a continous performance of the film printing method it is suggested in a further embodiment of the invention that the transfer film application is performed between two counter-rotating rollers of a transfer calender. It is furthermore advantageous to apply the required pressure for the final fixation of the transfer layer also by two counter-rotating rollers.

When according to one embodiment of the method the substrate is provided with an adhesive layer in a single- or multi-color printing device, a conventional printing device can be used for this portion of the method so that relatively low operating costs result. The adhesive layer may be coated with a base coat when the substrate is very absorbent. For this purpose a two-color printing device is especially suitable. With a two-color printing device it is also possible to apply a two-component adhesive as the adhesive layer.

For solving a partial object of the invention, i.e., to provide a suitable device for performing the method, a transfer film printing device with a printing station is suggested which comprises a supply device for the transfer film, a removing device for the tranfer film as well as a printing slot delimited on the one hand by a printing surface and on the other hand by a counter surface for guiding therethrough the substrate to be provided with a print design together with the transfer film supplied by the supply device for the transfer film. A device for applying an adhesive layer is positioned upstream of the printing station and has an applicator for applying the adhesive layer to the substrate. A pressing device is positioned downstream of the printing station and has a pressing slot which is on the one hand delimited by a pressing surface and on the other hand by a counter surface for guiding the substrate with the transferred print design therethrough.

This transfer film printing device is embodied such that the pressing surface as well as the counter surface is in the form of two smooth-surfaced rollers of a pressing calander. Preferably, the surface as well as the corresponding counter surface are also provided on smooth-surface rollers which in this case form a transfer calender.

In a further embodiment of the present invention, the printing station and the pressing device form a constructive unit, whereby the device for applying the adhesive layer which is positioned upstream is in the form of a known single or multicolor printing device.

Single- or multi-color printing device, printing station respectively transfer station and pressing device together form an inline transfer film printing device. It is possible without problems to arrange this transfer film printing device downstream of an endless printing machine or label printing machine in the sense of an inline production. The machine unit comprised of the printing station and the pressing device can also be positioned downstream of existing printing devices or adhesive applicator devices as an auxiliary device.

BRIEF DESCRIPTION OF THE DRAWINGS

Further details and advantages of the invention may be taken from the following description of the attached drawings in which preferred embodiments of the inventive method and of the inventive device are represented. The representations in the drawings do not accurately illustrate the actual dimensional ratios. It is shown in.

DESCRIPTION OF PREFERRED EMBODIMENTS

Figure 1:
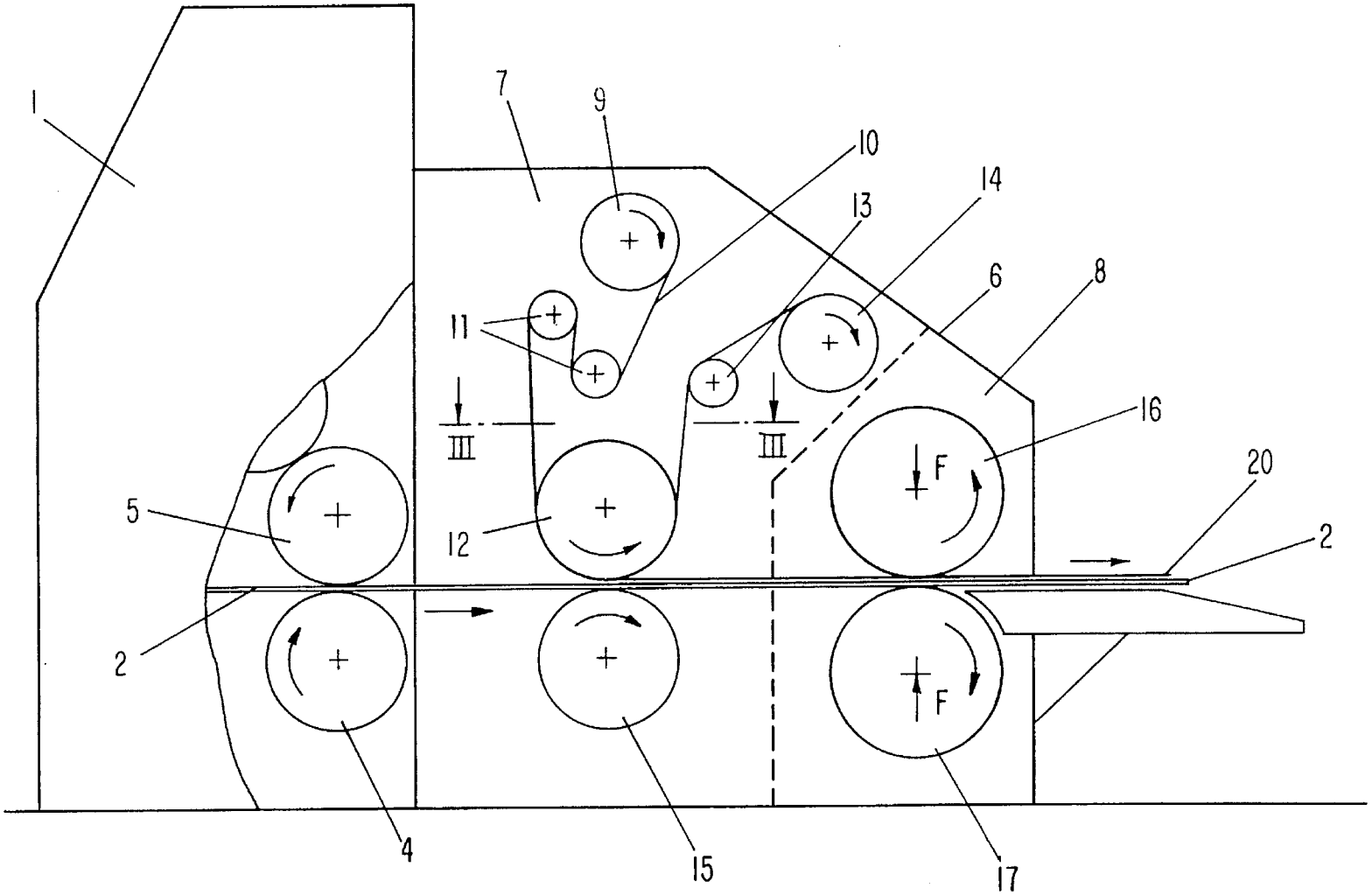
FIG. 1 in a simplified, partially sectioned side view a transfer film printing device with a device for applying an adhesive layer in the form of a known two-color printing device, a printing station for applying the transfer foil, and a pressing device.

The transfer film printing device represented in FIG. 1 is comprised of a total of two constructive groups. The constructive group represented in the left half of FIG. 1 is comprised of a conventional two-color printing device that in the context of the present invention, however, is used firstly as a device 1 for applying an adhesive layer for partially coating a substrate 2 to be provided with a print design with a thin adhesive layer 3, for example, a thin one- or two component adhesive film. For this purpose, the device 1 has, for example, a lower roller 4 as well as an upper roller 5 whereby the upper roller 5 is the applicator for the adhesive material and is in the form of a rubber sheet cylinder which applies the adhesive layer according to a given design partially to the substrate guided through the slot between the lower roller 4 and the upper roller 5, the substrate being, for example, a paper or cardboard strip.

In the right half of FIG. 1 the second constructive group contained in a common housing 6 is shown which is comprised of a transfer, respectively, printing station 7 and a pressing device 8.

In the printing station 7 the transfer film 10 supplied from the supply roll 9 is transferred partially to the substrate 2 guided through the printing slot of the pressing mechanism 7. For this purpose, the transfer film 10 is guided via two tensioning rollers 11 to a smooth-surfaced, optionally elastic, printing roller 12 and is guided from there via an intermediate roller 13 to a collecting roll 14. The printing roller 12 contacts at a defined pressure the chrome-plated counter roller 15 with the substrate 2 as well as the transfer film 10 being positioned therebetween and thus forms with the counter roller 15 a transfer calender.

The pressing device 8 is comprised of a calender with two rollers, the upper roller being a smooth-surfaced pressure roller 16 and the lower roller being counter roller 17 that is also smooth-surfaced. The pressure applied by the pressing roller 16 and the counter roller 17 is considerably greater than the pressure between the printing roller 12 and the counter roller 15.

Figure 2:
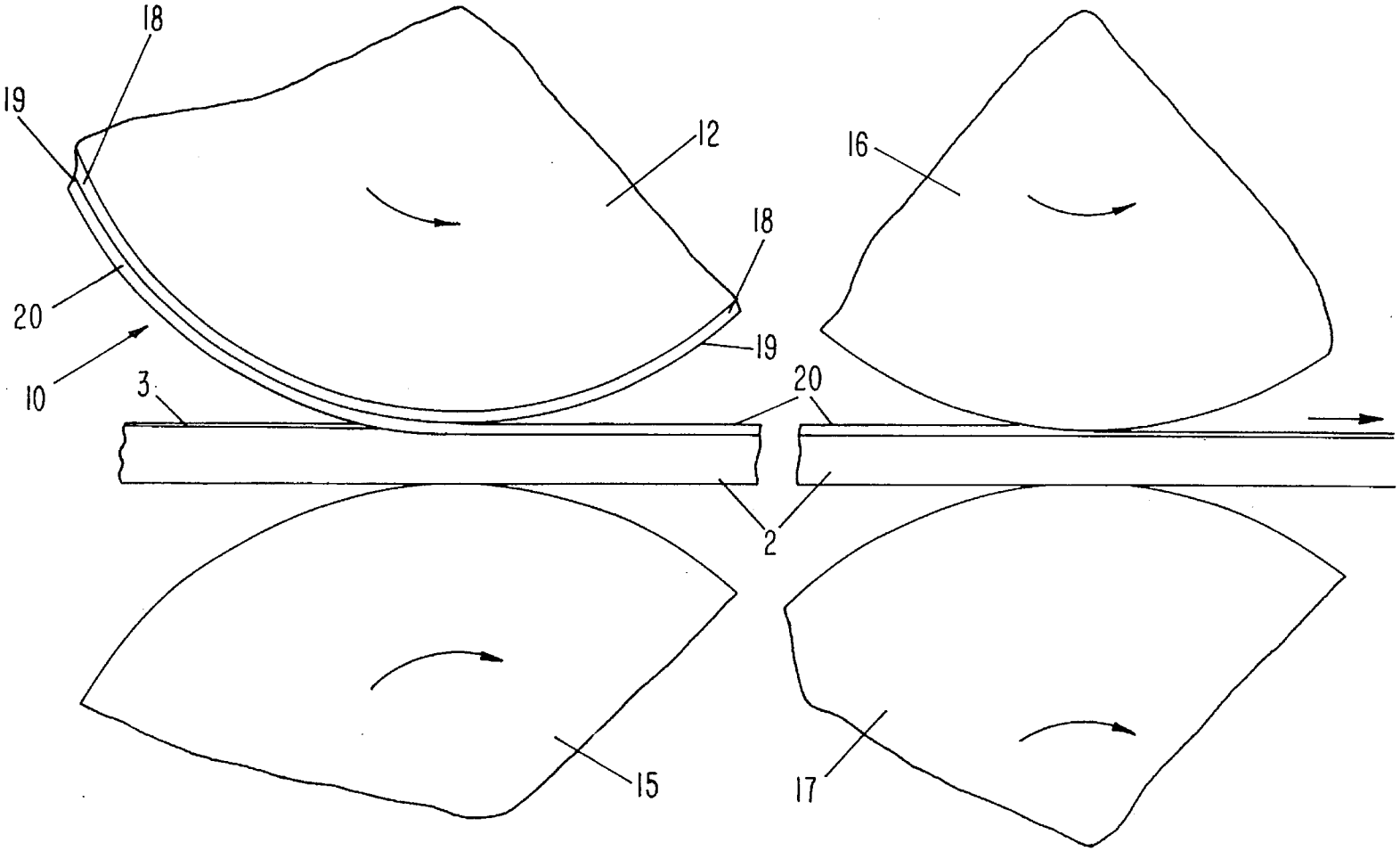
FIG. 2 shows detail representation of the printing station as well as the pressing device according to FIG. 1.

The transfer of the transfer film 10 within the printing station 7 is represented in the left half of FIG. 2. The transfer film 10 which has an approximate thickness of only 12 μm is comprised of a total of three layers. The innermost layer directly contacting the printing roller 12 is the support film 18 on which a transfer layer 20 is arranged with an intermediate separating layer 19 serving as an adhesive support. The transfer layer 20 is thus relatively easily removable from the support film 18. The transfer layer 20 itself is comprised of two layers and comprises essentially a thin vapor-deposited aluminum layer and, for example, a colored lacquer layer. This two-layer construction of the transfer layer 20 is not represented in the drawings.

When performing the transfer the substrate 2 to be provided with a printed design is guided at the circumferential velocity of the printing roller 12, respectively, counter roller 15 through the printing slot provided between the two rollers 12, 15 whereby the transfer film 10 entrained on the cloth surface of the printing roller 12 is partially transferred to the substrate 2. This transfer takes place exclusively at the locations of the substrate 2 which have been provided in the upstream device for applying an adhesive layer with the adhesive layer 3. Also, the transfer film 10 is not completely transferred to the substrate 2, but exclusively the transfer layer 20 which can be easily removed from the support film 18. Upon leaving the printing station 7 the transfer layer 20 thus adheres partially to the substrate at the locations supplied with the adhesive layer 3. The transfer layer 20 is, for example, a gold foil, wherein the aluminum layer creates the metallic effect, while the gold color is achieved by providing a yellow to ocher colored lacquer layer.

In order to provide the required permanence to the transfer film application within the printing station 7, the substrate 2 with the adhered transfer layer 20 is subsequently guided between the pressing roller 16 and the counter roller 17 of the pressing device 8. While the pressure application within the pressing station 7 must only be sufficient to transfer the transfer layer 20 from the support film 18 to the substrate 2, the pressure within the pressing device 8 is substantially higher in order to afford the intimate connection between the transfer layer 20 and the substrate 2.

Figure 3:
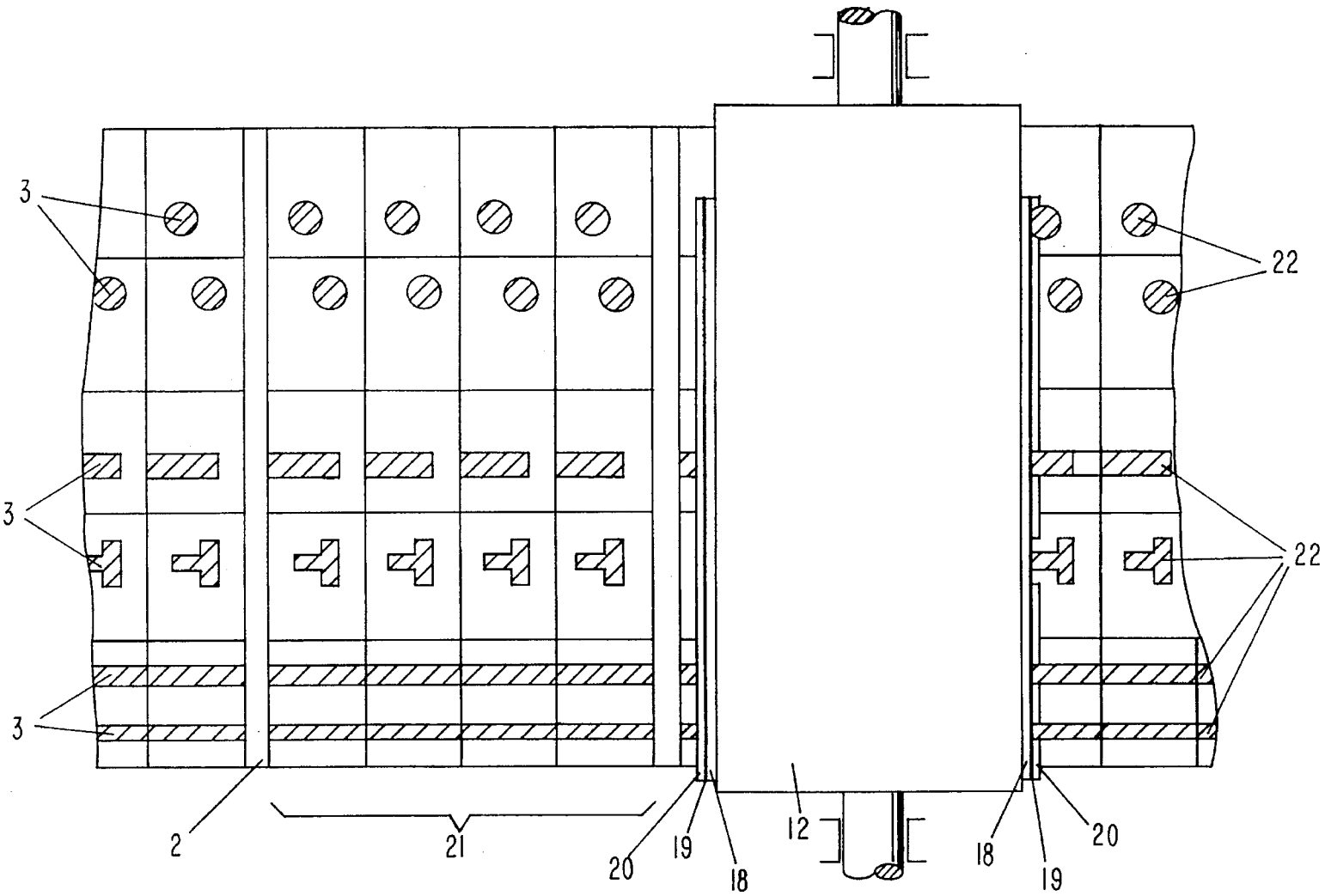
FIG. 3 shows a partial top view of the pressing mechanism in the section plane III—III of FIG. 1.

The method of applying the transfer film within the printing station 7 is represented in FIG. 3 for one example. For an endless printing process the substrate 2 is comprised of print sheets 21 having a 4×5 field arrangement. For demonstrating the printing method the sheet 21 is provided with five different print designs 22 which are repeated four times over the length of the sheet 21. In the left portion of FIG. 3 the print sheets 21 are represented in the stage before being guided through the printing station 7 with the printing roller 12. In the area of the individual print designs 22 the print sheet 21 is already provided with a partial adhesive layer 3. After exiting from the printing roller 12 the print sheets 21 in the area of the partial adhesive layer 3 are provided with the transfer layer 20 and thus form the finished applied print designs 22. Within the area of the print designs 22 the transfer layer 20 is missing from the transfer film 10 resting at the printing roller 12, as can be seen in the right portion of FIG. 3.

Instead of the transfer film 10 represented in FIG. 3 which extends over substantially the entire width of the pressing roller 12 and the counter roller 15 of the transfer calender, it is also possible to use individual strips of transfer film. This is especially advantageous when the printing design 22 is only distributed over a portion of the width of the rollers. For saving transfer film it is furthermore possible to interrupt the transport of the transfer film at least partially with respect to the transport of the substrate by opening the transfer calender and to advance the transfer film in a fixed-cycle operation. It is also possible to employ a plurality of narrow film strips or to operate the transfer calender at a cyclic pressure.

The present invention is, of course, in no way restricted to the specific disclosure of the specification and drawings, but also encompasses any modifications within the scope of the appended claims.

We claim:

1. A film printing method for printing a print design on a substrate, said method comprising the steps of:

coating areas of a surface of a substrate to be provided with a print design with an adhesive layer;

providing a transfer film comprised of a support film having a separating layer connected thereto and a transfer layer connected to said separating layer;

printing at a first pressure said transfer film with said transfer layer facing said adhesive layer onto said substrate so that said transfer layer adheres to said adhesive layer of said substrate;

removing said support film together with said separating layer from said transfer layer adhering to said substrate; and subjecting said transfer layer adhering to said adhesive layer on said substrate to a second pressure that is substantially greater than said first pressure.

2. A method according to claim 1, further comprising the step of employing a smooth printing surface for performing said step of printing.

3. A method according to claim 2, wherein said smooth printing surface is elastic.

4. A method according to claim 2, wherein said first pressure is insufficient to press said transfer layer into said substrate.

5. A method according to claim 1, wherein said step of pressing is performed at ambient temperature.

6. A method according to claim 1, further comprising the step of providing two counter-rotating rollers of a first calender for performing the step of printing.

7. A method according to claim 6, wherein in said step of subjecting two further counter-rotating rollers of a second calender are employed.

8. A method according to claim 6, further comprising the step of operating said first calender at a fixed-cycle operation.

9. A method according to claim 1, wherein said step of coating includes the step of applying said adhesive in multiple steps.

10. A method according to claim 9, wherein said adhesive is a multi-component adhesive.

11. A method according to claim 1, further comprising the step of employing a single-color printing device for said coating step.

12. A method according to claim 1, further comprising the step of employing a multi-color printing device for said coating step.

* * * * *